US008988338B2

(12) United States Patent
Otoi et al.

(10) Patent No.: US 8,988,338 B2
(45) Date of Patent: Mar. 24, 2015

(54) IMAGE DISPLAY DEVICE HAVING A PLURALITY OF IMAGE CORRECTION MODES FOR A PLURALITY OF IMAGE AREAS AND IMAGE DISPLAY METHOD

(75) Inventors: Katsuya Otoi, Osaka (JP); Kohji Fujiwara, Osaka (JP); Katsuteru Hashimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 322 days.

(21) Appl. No.: 13/393,940

(22) PCT Filed: May 18, 2010

(86) PCT No.: PCT/JP2010/058328

§ 371 (c)(1), (2), (4) Date: Mar. 2, 2012

(87) PCT Pub. No.: WO2011/040084

PCT Pub. Date: Apr. 7, 2011

(65) Prior Publication Data

US 2012/0154459 A1 Jun. 21, 2012

(30) Foreign Application Priority Data

Sep. 30, 2009 (JP) ..... 2009-226128

(51) Int. Cl.
*G09G 3/36* (2006.01)
*G09G 3/34* (2006.01)

(52) U.S. Cl.
CPC ..... *G09G 3/3426* (2013.01); *G09G 3/3413* (2013.01); *G09G 2320/0233* (2013.01); (Continued)

(58) Field of Classification Search
CPC ..... G09G 3/3406
USPC ..... 345/102
See application file for complete search history.

(56) References Cited

U.S. PATENT DOCUMENTS

2005/0212825 A1* 9/2005 Lee et al. ..... 345/690
2009/0267926 A1* 10/2009 Seo et al. ..... 345/204
(Continued)

FOREIGN PATENT DOCUMENTS

JP 3198026 A 8/1991
JP 2009058566 A 3/2009
JP 2009-198530 A 9/2009
WO WO 2008/152832 * 12/2008
WO WO-2009096068 A1 8/2009

OTHER PUBLICATIONS

International Search Report.

*Primary Examiner* — Long D Pham
(74) *Attorney, Agent, or Firm* — Harness, Dickey & Pierce, P.L.C.

(57) ABSTRACT

In an image display device which performs area-active drive, backlight sources are emitted with appropriate luminances while inhibiting increase in power consumption and inhibiting reduction of image quality. An emission luminance calculation section divides an input image into a plurality of areas, and obtains luminances upon emission (first emission luminances) of LEDs in the areas. A plurality of correction modes are prepared as methods for correcting the first emission luminances, and a correction mode that is applied to an emission luminance correction process (selected correction mode) is stored to a correction mode storage section. For any LED units whose flag data stored in a correction-enabled map has the value of 1, an emission luminance correction section corrects their first emission luminances to obtain second emission luminances in accordance with the selected correction mode, with reference to correction value data stored in correction value tables.

12 Claims, 15 Drawing Sheets

(52) U.S. Cl.
CPC ..... *G09G2320/0238* (2013.01); *G09G 2320/0242* (2013.01); *G09G 2320/0646* (2013.01); *G09G 2330/021* (2013.01); *G09G 2340/0414* (2013.01); *G09G 2340/0421* (2013.01); *G09G 2360/16* (2013.01)
USPC ..... 345/102

(56) References Cited

U.S. PATENT DOCUMENTS

| | | | | |
|---|---|---|---|---|
| 2010/0013872 | A1* | 1/2010 | Masuda et al. | 345/691 |
| 2010/0225574 | A1 | 9/2010 | Fujiwara et al. | |

* cited by examiner

Fig.6

| y \ x | 0 | 1 | 2 | 3 | 4 | 5 | 6 | 7 |
|---|---|---|---|---|---|---|---|---|
| 0 | 0 | 0 | 0 | 0 | 0 | 0 | 0 | 0 |
| 1 | 1 | 1 | 1 | 1 | 1 | 1 | 1 | 1 |
| 2 | 1 | 1 | 1 | 1 | 1 | 1 | 1 | 1 |
| 3 | 0 | 0 | 0 | 0 | 0 | 0 | 0 | 0 |

Fig.7

FOR RED

| y \ x | 0 | 1 | 2 | 3 | 4 | 5 | 6 | 7 |
|---|---|---|---|---|---|---|---|---|
| 0 | 8 | 9 | 9 | 9 | 8 | 6 | 5 | 4 |
| 1 | 8 | 9 | 10 | 10 | 9 | 8 | 6 | 5 |
| 2 | 8 | 9 | 10 | 9 | 9 | 6 | 5 | 4 |
| 3 | 7 | 8 | 8 | 9 | 8 | 6 | 5 | 3 |

FOR GREEN

| y \ x | 0 | 1 | 2 | 3 | 4 | 5 | 6 | 7 |
|---|---|---|---|---|---|---|---|---|
| 0 | 5 | 5 | 6 | 7 | 8 | 6 | 5 | 2 |
| 1 | 4 | 5 | 6 | 8 | 7 | 6 | 5 | 3 |
| 2 | 5 | 5 | 6 | 9 | 8 | 7 | 5 | 4 |
| 3 | 7 | 6 | 7 | 8 | 8 | 6 | 4 | 0 |

FOR BLUE

| y \ x | 0 | 1 | 2 | 3 | 4 | 5 | 6 | 7 |
|---|---|---|---|---|---|---|---|---|
| 0 | 0 | 2 | 4 | 2 | 1 | 1 | 0 | 0 |
| 1 | 1 | 5 | 10 | 5 | 3 | 1 | 1 | 1 |
| 2 | 1 | 4 | 6 | 5 | 3 | 1 | 0 | 0 |
| 3 | 0 | 3 | 5 | 3 | 2 | 1 | 0 | 0 |

Fig.8

| y \ x | 0 | 1 | 2 | 3 | 4 | 5 | 6 | 7 |
|---|---|---|---|---|---|---|---|---|
| 0 | 0 | 1 | 2 | 3 | 4 | 5 | 6 | 7 |
| 1 | 8 | 9 | 10 | 11 | 12 | 13 | 14 | 15 |
| 2 | 16 | 17 | 18 | 19 | 20 | 21 | 22 | 23 |
| 3 | 24 | 25 | 26 | 27 | 28 | 29 | 30 | 31 |

| | | | | |
|---|---|---|---|---|
| 10 | 20 | 30 | 20 | 10 |
| 20 | 50 | 80 | 50 | 20 |
| 30 | 80 | 100 | 80 | 30 |
| 20 | 50 | 80 | 50 | 20 |
| 10 | 20 | 30 | 20 | 10 |

CENTER AREA

IMAGE DISPLAY DEVICE HAVING A PLURALITY OF IMAGE CORRECTION MODES FOR A PLURALITY OF IMAGE AREAS AND IMAGE DISPLAY METHOD

TECHNICAL FIELD

The present invention relates to image display devices, particularly to an image display device having a function of controlling the luminance of a backlight (backlight dimming function).

BACKGROUND ART

In image display devices provided with backlights such as liquid crystal display devices, by controlling the luminances of the backlights on the basis of input images, the power consumption of the backlights can be suppressed and the image quality of a displayed image can be improved. In particular, by dividing a screen into a plurality of areas and controlling the luminances of backlight sources corresponding to the areas on the basis of portions of an input image within the areas, it is rendered possible to achieve lower power consumption and higher image quality. Hereinafter, such a method for driving a display panel while controlling the luminances of backlight sources on the basis of an input image in each area will be referred to as "area-active drive".

Liquid crystal display devices that perform area-active drive use, for example, LEDs (light emitting diodes) of three RGB colors or white LEDs, as backlight sources. Luminances upon emission (hereinafter, referred to as "emission luminances") of LEDs corresponding to areas are obtained on the basis of, for example, maximum or mean values of pixel luminances within the areas, and are provided to a backlight driver circuit as LED data. In addition, display data (data for controlling the light transmittance of the liquid crystal) is generated on the basis of the LED data and an input image, and the display data is provided to a driver circuit for a liquid crystal panel.

According to a liquid crystal display device such as that described above, suitable display data and LED data are obtained based on an input image, and the light transmittances of liquid crystals are controlled based on the display data, and the emission luminances of LEDs provided in respective areas are controlled based on the LED data, whereby the input image can be displayed on the liquid crystal panel. When the luminance of pixels in an area is low, by reducing the emission luminance of LEDs provided in the area, the power consumption of the backlight can be reduced.

Note that the following conventional technology document is known in the art relevant to the present invention. International Publication WO2009/096068 pamphlet discloses an invention of an image display device in which, to inhibit flickering from occurring when displaying dynamic images, an emission luminance of LEDs is obtained for each area within the range between upper and lower limits calculated on the basis of an average luminance level among images for one frame.

PRIOR ART DOCUMENT

Patent Document

Patent Document 1: International Publication WO2009/096068 pamphlet

SUMMARY OF THE INVENTION

Problems to be Solved by the Invention

In liquid crystal display devices which perform the aforementioned area-active drive, when only a small number of LEDs are lit up, insufficient luminance might occur in portions where display with high luminance is performed. The reason for this is as follows. The LED emission luminance for each area is obtained on the basis of a luminance distribution for an input image in that area. Here, in general, from the point view of reducing power consumption, the light transmittance of the liquid crystal is increased as much as possible, thereby controlling the LED emission luminance so as not to be unnecessarily high. In addition, light emitted by LEDs in a certain area illuminates not only that area but also its surrounding areas. In other words, a luminance appearing in an area (hereinafter, referred to as a "display luminance") is not determined only by the LED emission luminance in that area, and it is also affected by light emitted by LEDs in surrounding areas. In consideration of this, in general, a luminance appearing on the screen when all LEDs are lit up at the brightest level is set as a luminance corresponding to a highest tone value which is displayable. In this case, if only a small number of LEDs are lit up, each lit-up area receives a relatively low effect (the effect having a tendency toward increasing the luminance) from its surrounding areas, so that insufficient luminance might occur depending on the tone value for each pixel included in the lit-up area.

Therefore, to prevent insufficient luminance from occurring when only a small number of LEDs are lit up, a process is performed to uniformly increase emission luminances of all LEDs by a value equivalent to a predetermined tone. By the way, an LED emission luminance in each area is obtained on the basis of a luminance distribution for an input image in that area, as described above. Accordingly, an emission luminance obtained on the basis of a luminance distribution for an input image for each area is corrected for the purpose of, for example, preventing occurrence of insufficient luminance as described above, and such a correction process will be referred to below as an "emission luminance correction process". In addition, an amount (magnitude) of luminance to be corrected by the emission luminance correction process will be referred to below as an "offset amount".

FIG. 16 is a diagram schematically illustrating an image which represents "a state where only one star is shining in the night sky" (the pixel corresponding to the star in FIG. 16 will be referred to as the "high-tone pixel"). In the case where the image as shown in FIG. 16 is displayed, if the emission luminance correction process is not performed, emission luminances for areas along line A-A are as shown in FIG. 17. Specifically, only the LEDs in the area that includes the high-tone pixel are lit up. On the other hand, when the emission luminance correction process is performed, the emission luminances for the areas on line A-A are as shown in FIG. 18. Specifically, when compared to the case where the emission luminance correction process is not performed, emission luminances of LEDs in all of the areas are increased by a value equivalent to a predetermined offset amount. As a result, the area including the high-tone pixel is significantly affected by its surrounding areas, such that the display luminance is increased. Consequently, the display luminance for the area including the high-tone pixel is increased to such an extent as to overcome insufficient luminance.

However, the conventional emission luminance correction process increases emission luminances of LEDs in areas, as denoted by characters "91" and "92" in FIG. 18, which are distant from the area including the high-tone pixel. If the LEDs in such areas emit light, they make little or no contribution to increase the display luminance of the area including the high-tone pixel. Accordingly, in the case of the conventional emission luminance correction process, unnecessary power consumption occurs. In addition, in portions to be displayed in black, although the liquid crystal is closed, the display might be faintly illuminated by the LEDs being lit up. Such a phenomenon is referred to as "impure black", and contributes to reduced image quality.

Therefore, an objective of the present invention is to allow backlight sources to emit light with appropriate luminances while inhibiting increase in power consumption and inhibiting reduction of image quality due to impure black, in an image display device which performs area-active drive.

Means for Solving the Problems

A first aspect of the present invention is directed to an image display device having a function of controlling a backlight luminance, comprising:

a display panel including a plurality of display elements;

a backlight including a plurality of light sources;

an emission luminance calculation section for dividing an input image into a plurality of areas and obtaining luminances upon emission of light sources corresponding to each area as first emission luminances on the basis of a portion of the input image of a corresponding area;

an emission luminance correction section for obtaining second emission luminances by correcting the first emission luminances in accordance with a selected correction mode which is selected from among a plurality of prepared correction modes;

a display data calculation section for obtaining display data for controlling light transmittances of the display elements, on the basis of the input image and the second emission luminances;

a panel driver circuit for outputting signals for controlling the light transmittances of the display elements to the display panel, on the basis of the display data; and a backlight driver circuit for outputting signals for controlling luminances of the light sources to the backlight, on the basis of the second emission luminances.

According to a second aspect of the present invention, in the first aspect of the present invention, the image display device further comprises a correction value storage section having stored therein correction values corresponding to the areas, wherein, the plurality of correction modes include a first correction mode in which, for each area, the greater of a value for the first emission luminance and the correction value stored in the correction value storage section is set as the second emission luminance.

According to a third aspect of the present invention, in the first aspect of the present invention, the image display device further comprises a correction value storage section having stored therein correction values corresponding to the areas, wherein, the plurality of correction modes include a second correction mode in which, for each area, the lesser of a value for the maximum emission luminance of the light sources and a value obtained by adding a value for the first emission luminance to the correction value stored in the correction value storage section is set as the second emission luminance.

According to a fourth aspect of the present invention, in the second or third aspect of the present invention, the plurality of correction modes includes a third correction mode in which, for each area, the correction value stored in the correction value storage section is set as the second emission luminance, and a fourth correction mode in which, for each area, the value for the first emission luminance is set as the second emission luminance.

According to a fifth aspect of the present invention, in the first aspect of the present invention, the image display device further comprises a correction value storage section having stored therein correction values corresponding to the areas, wherein, the plurality of correction modes include a first correction mode in which, for each area, the greater of a value for the first emission luminance and the correction value stored in the correction value storage section is set as the second emission luminance, a second correction mode in which, for each area, the lesser of a value for the maximum emission luminance of the light sources and a value obtained by adding a value for the first emission luminance to the correction value stored in the correction value storage section is set as the second emission luminance, a third correction mode in which, for each area, the correction value stored in the correction value storage section is set as the second emission luminance, and a fourth correction mode in which, for each area, the value for the first emission luminance is set as the second emission luminance.

According to a sixth aspect of the present invention, in the first aspect of the present invention, the image display device further comprises a correctability data storage section having stored therein correctability data corresponding to the areas as data indicating whether or not to perform a correction in accordance with the selected correction mode, wherein, the emission luminance correction section sets the value for the first emission luminance as the second emission luminance for any area for which the correctability data stored in the correctability data storage section indicates that the correction in accordance with the selected correction mode is not performed.

A seventh aspect of the present invention is directed to an image display method in an image display device provided with a display panel including a plurality of display elements and a backlight including a plurality of light sources, the method comprising:

an emission luminance calculation step for dividing an input image into a plurality of areas and obtaining luminances upon emission of light sources corresponding to each area as first emission luminances on the basis of a portion of the input image of a corresponding area;

an emission luminance correction step for obtaining second emission luminances by correcting the first emission luminances in accordance with a selected correction mode which is selected from among a plurality of prepared correction modes;

a display data calculation step for obtaining display data for controlling light transmittances of the display elements, on the basis of the input image and the second emission luminances;

a panel drive step for outputting signals for controlling the light transmittances of the display elements to the display panel, on the basis of the display data; and a backlight drive step for outputting signals for controlling luminances of the light sources to the backlight, on the basis of the second emission luminances.

In addition, variants that are grasped by referring to the embodiment and the drawings in the seventh aspect of the present invention are considered to be means for solving the problems.

Effects of the Invention

According to the first aspect of the present invention, (light sources') emission luminances (first emission luminances), obtained for each area on the basis of an input image, are corrected by a correction mode (selected correction mode) which is selected from among a plurality of prepared correction modes. Thus, unlike the conventional correction method where a luminance equivalent to a predetermined offset amount is uniformly added to emission luminances of all of the light sources, it is possible to correct the emission luminances of the light sources in a more flexible manner.

According to the second aspect of the present invention, for example, correction values for light sources at the center of the panel and its surrounding portions can be set to be relatively high, and correction values for light sources at the edge of the panel and its surrounding portions can also be set to be relatively high. In this manner, when emission luminances are corrected, a minimum required emission luminance can be determined for each light source, rather than a luminance equivalent to a common offset amount being added to each of the values for the emission luminances of all light sources. Accordingly, it is possible to ensure that light sources in a desired region within the panel emit light with a predetermined luminance or higher. As a result, in such a region, it is possible to inhibit insufficient luminance from occurring and to maintain satisfactory image quality. Moreover, for any light sources to which correction values stored in the correction value storage section are applied as second emission luminances, their luminances are not increased unnecessarily, and the light sources emit light with their minimum possible luminances that do not cause insufficient luminance. Thus, when compared to the conventional configuration, power consumption can be reduced more effectively. In addition, not all of the emission luminances of the light sources are increased by correction, and therefore, the contrast ratio within the panel is inhibited from being reduced.

According to the third aspect of the present invention, for example, correction values for light sources at the center of the panel and its surrounding portions can be set to be relatively high, and correction values for light sources at the edge of the panel and its surrounding portions can also be set to be relatively high. In this manner, when emission luminances are corrected, a luminance equivalent to a different offset amount can be added to the value for an emission luminance of each light source, rather than a luminance equivalent to a common offset amount being added to each of the values for the emission luminances of all light sources. In addition, for all of the light sources, their second emission luminances can be calculated by adding luminances, which are equivalent to offset amounts determined for their respective light sources, to the first emission luminances, except in the case where the maximum luminance is exceeded. As a result, a satisfactory luminance balance is maintained across the entire panel, and the emission luminance of each light source is increased. Thus, it is possible to inhibit any halo (image blurring) phenomenon or suchlike from occurring due to the difference in luminance between light sources.

According to the fourth aspect of the present invention, by providing the third correction mode, the following effects can be achieved. First, light sources that are not required to be lit up can be forcibly set in off state. Thus, power consumption can be reduced. Moreover, when a specific image that is to be provided with high luminance is displayed, the luminance of the light sources that correspond to the image portion can be increased. Thus, the image can be rendered conspicuous. Moreover, when a luminance distribution is measured, it is possible to generate luminance data such that only the light sources in (arbitrarily) designated positions are lit up with (arbitrarily) designated luminances. Thus, it is possible to readily create a desired environment for development, and thereby to enhance development efficiency. Furthermore, by providing the fourth correction mode, the following effects can be achieved. When the emission luminance of each light source is increased by correction, the contrast ratio within the panel might be reduced, but when the fourth correction mode is selected, emission luminance correction is not performed, so that the contrast ratio is prevented from being reduced.

According to the fifth aspect of the present invention, the same effects as those achieved by the second through fourth aspects of the invention can be achieved.

According to the sixth aspect of the present invention, with the correctability data storage section, it is possible to determine for each area whether or not to correct its emission luminance. Thus, for example, it is possible to determine the emission luminance not to be corrected for any light sources in the areas that are to be displayed in black, so that unnecessary power consumption can be inhibited, and reduction of image quality due to impure black can be inhibited.

BRIEF DESCRIPTION OF THE DRAWINGS

FIG. 6 is a diagram illustrating an example correction-enabled map in the embodiment.

FIG. 7 is a diagram describing correction value tables in the embodiment.

FIG. 8 is a diagram describing LED numbers in the embodiment.

MODE FOR CARRYING OUT THE INVENTION

Hereinafter, an embodiment of the present invention will be described with reference to the accompanying drawings.

<1. Overall Configuration and Overview of the Operation>

Figure 2:
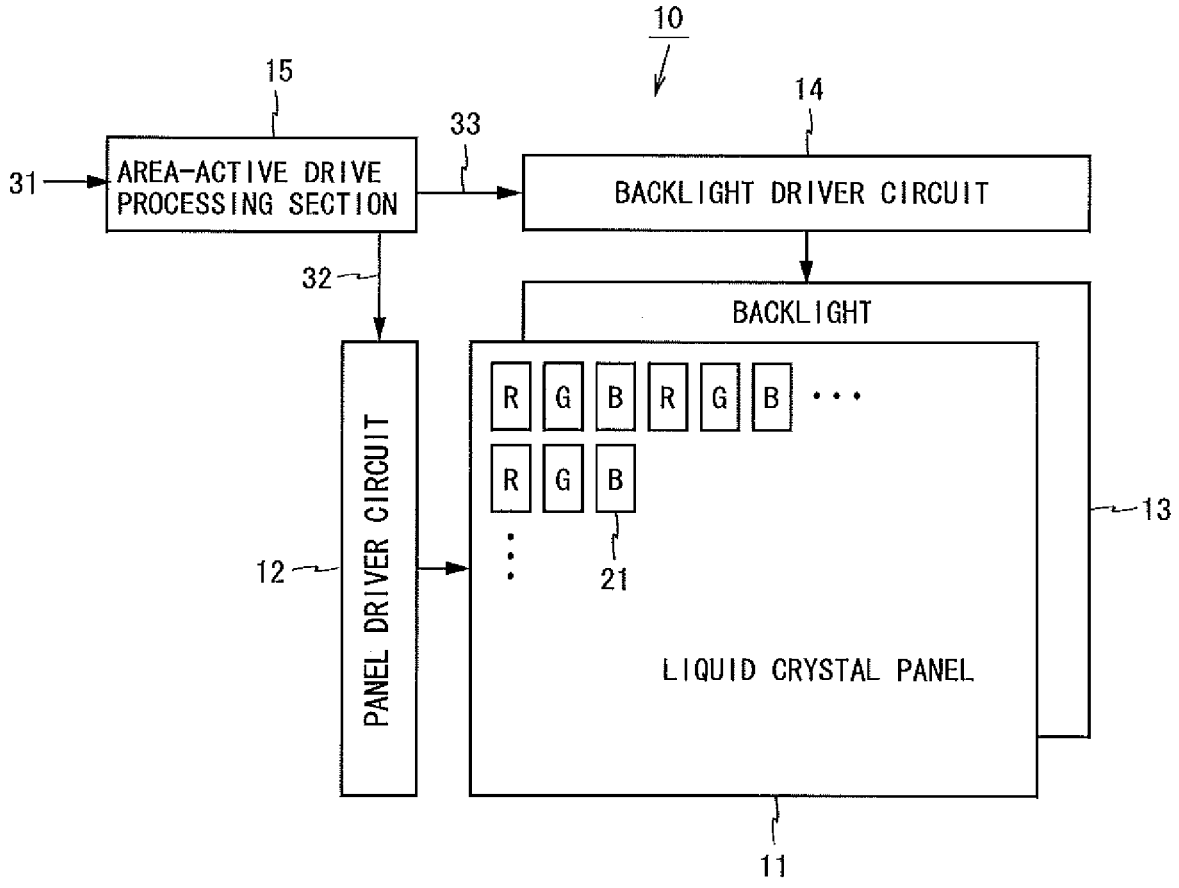
FIG. 2 is a block diagram illustrating the configuration of a liquid crystal display device according to the embodiment.

FIG. 2 is a block diagram illustrating the configuration of a liquid crystal display device 10 according to an embodiment of the present invention. The liquid crystal display device 10 shown in FIG. 2 includes a liquid crystal panel 11, a panel driver circuit 12, a backlight 13, a backlight driver circuit 14, and an area-active drive processing section 15. The liquid crystal display device 10 performs area-active drive in which the liquid crystal panel 11 is driven with luminances of backlight sources being controlled on the basis of input image portions within a plurality of areas defined by dividing the screen. In the following, m and n are integers of 2 or more, p and q are integers of 1 or more, but at least one of p and q is an integer of 2 or more.

The liquid crystal display device 10 receives an input image 31 including an R image, a G image, and a B image. Each of the R, G, and B images includes luminances for (m×n) pixels. On the basis of the input image 31, the area-active drive processing section 15 obtains display data (hereinafter, referred to as "liquid crystal data 32") for use in driving the liquid crystal panel 11 and emission luminance control data (hereinafter, referred to as "LED data 33") for use in driving the backlight 13 (details will be described later).

The liquid crystal panel 11 includes (m×n×3) display elements 21. The display elements 21 are arranged two-dimensionally as a whole, with each row including 3*m* of them in its direction (in FIG. 2, horizontally) and each column including n of them in its direction (in FIG. 2, vertically). The display elements 21 include R, G, and B display elements respectively transmitting red, green, and blue light therethrough. The R display elements, the G display elements, and the B display elements are arranged side by side in the row direction, and these three display elements form a single pixel. However, the arrangement of display elements is not limited to this pattern.

The panel driver circuit 12 is a circuit for driving the liquid crystal panel 11. On the basis of liquid crystal data 32 outputted by the area-active drive processing section 15, the panel driver circuit 12 outputs signals (voltage signals) for controlling light transmittances of the display elements 21 to the liquid crystal panel 11. The voltages outputted by the panel driver circuit 12 are written to pixel electrodes in the display elements 21, and the light transmittances of the display elements 21 change in accordance with the voltages written to the pixel electrodes.

Figure 3:
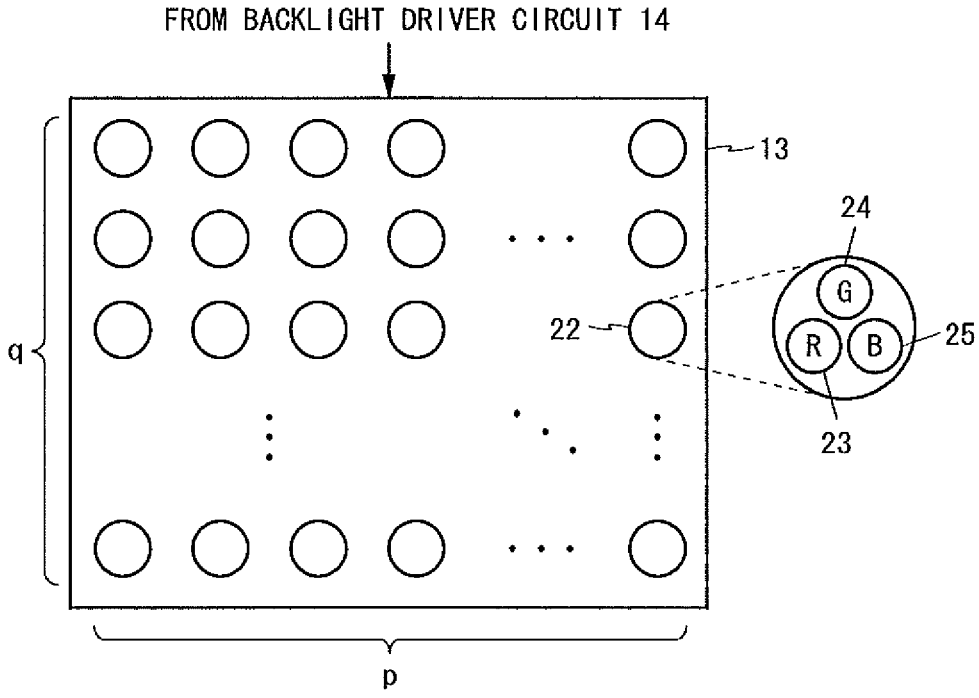
FIG. 3 is a diagram illustrating details of a backlight shown in FIG. 2.

The backlight 13 is provided at the back side of the liquid crystal panel 11 to irradiate backlight light to the back of the liquid crystal panel 11. FIG. 3 is a diagram illustrating details of the backlight 13. The backlight 13 includes (p×q) LED units 22, as shown in FIG. 3. The LED units 22 are arranged two-dimensionally as a whole, with each row including p of them in its direction and each column including q of them in its direction. Each of the LED units 22 includes one red LED 23, one green LED 24, and one blue LED 25. Lights emitted from the three LEDs 23 to 25 included in one LED unit 22 hit a part of the back of the liquid crystal panel 11.

The backlight driver circuit 14 is a circuit for driving the backlight 13. On the basis of LED data 33 outputted by the area-active drive processing section 15, the backlight driver circuit 14 outputs signals (pulse signals PWM or current signals) for controlling luminances of the LEDs 23 to 25 to the backlight 13. The emission luminances of the LEDs 23 to 25 are controlled independently of emission luminances of LEDs inside and outside their units.

The screen of the liquid crystal display device 10 is divided into (p×q) areas, each area corresponding to one LED unit 22. For each of the (p×q) areas, the area-active drive processing section 15 obtains the emission luminance of the red LEDs 23 that correspond to that area on the basis of an R image within that area. Similarly, the emission luminance of the green LEDs 24 is determined on the basis of a G image within the area, and the emission luminance of the blue LEDs 25 is determined on the basis of a B image within the area. The area-active drive processing section 15 obtains emission luminances for all LEDs 23 to 25 included in the backlight 13, and outputs LED data 33 representing the obtained emission luminances to the backlight driver circuit 14.

Furthermore, on the basis of the LED data 33, the area-active drive processing section 15 obtains luminances of backlight lights (display luminances) for all display elements 21 included in the liquid crystal panel 11. In addition, on the basis of an input image 31 and the display luminances, the area-active drive processing section 15 obtains light transmittances of all of the display elements 21 included in the liquid crystal panel 11, and outputs liquid crystal data 32 representing the obtained light transmittances to the panel driver circuit 12.

In the liquid crystal display device 10, the luminance of each R display element is the product of the luminance of red light emitted by the backlight 13 and the light transmittance of that R display element. Light emitted by one red LED 23 hits a plurality of areas around one corresponding area. Accordingly, the luminance of each R display element is the product of the total luminance of light emitted by a plurality of red LEDs 23 and the light transmittance of that R display element. Similarly, the luminance of each G display element is the product of the total luminance of light emitted by a plurality of green LEDs 24 and the light transmittance of that G display element, and the luminance of each B display element is the product of the total luminance of light emitted by a plurality of blue LEDs 25 and the light transmittance of that B display element.

According to the liquid crystal display device 10 thus configured, suitable liquid crystal data 32 and LED data 33 are obtained on the basis of the input image 31, the light transmittances of the display elements 21 are controlled on the basis of the liquid crystal data 32, and the emission luminances of the LEDs 23 to 25 are controlled on the basis of the LED data 33, so that the input image 31 can be displayed on the liquid crystal panel 11. In addition, when luminances of pixels within an area are low, emission luminances of LEDs 23 to 25 corresponding to that area are kept low, thereby reducing power consumption of the backlight 13. Moreover, when luminances of pixels within an area are low, luminances of display elements 21 corresponding to that area are switched among a smaller number of levels, making it possible to enhance image resolution and thereby to improve display image quality.

Figure 4:
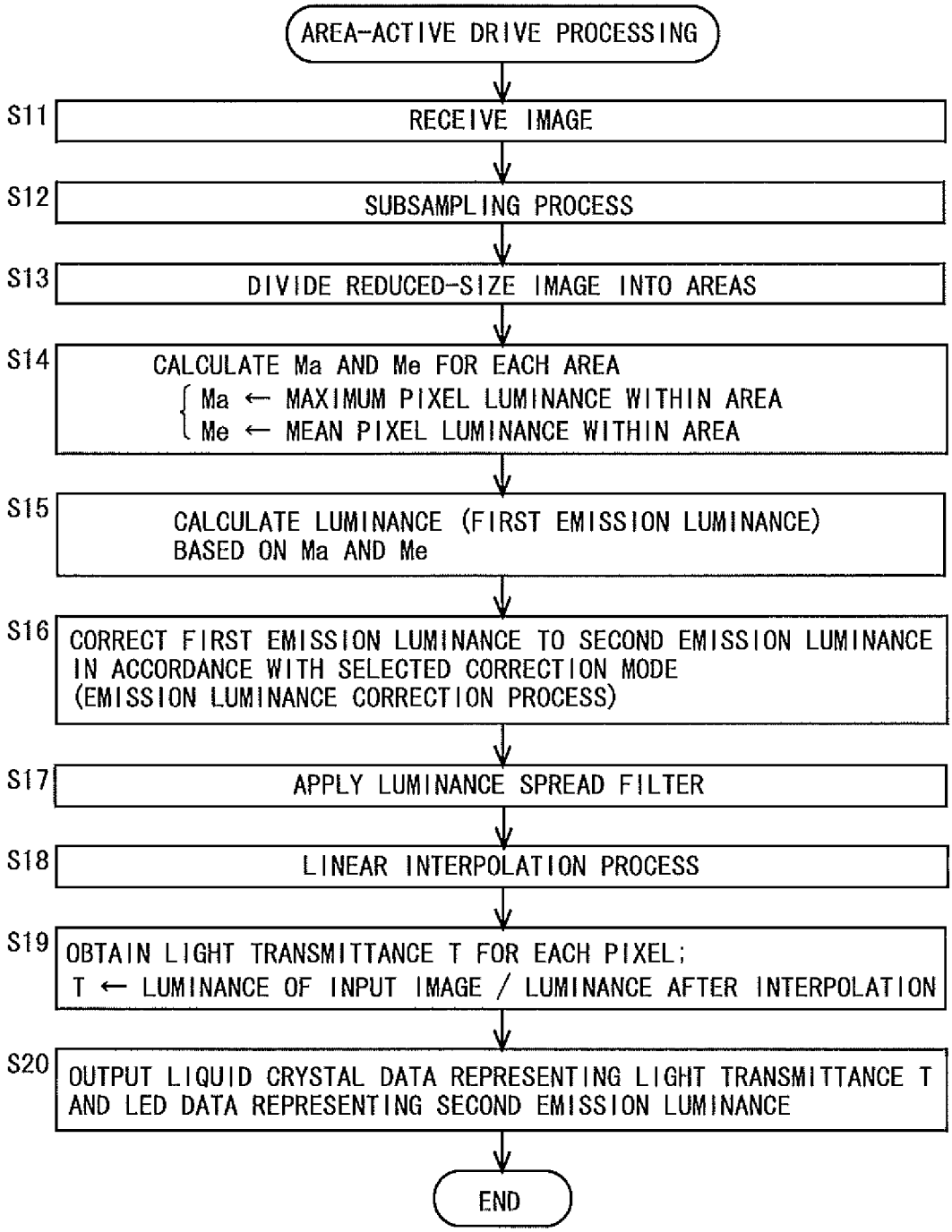
FIG. 4 is a flowchart showing a process by the area-active drive processing section in the embodiment.

FIG. 4 is a flowchart showing a process by the area-active drive processing section 15. The area-active drive processing section 15 receives an image for a color component (hereinafter, referred to as color component c) included in the input image 31 (step S11). The input image for color component C includes luminances for (m×n) pixels.

Next, the area-active drive processing section 15 performs a subsampling process (averaging process) on the input image for color component c, and obtains a reduced-size image including luminances for (sp×sq) (where s is an integer of 2 or more) pixels (step S12). In step S12, the input image for color component c is reduced to sp/min the horizontal direction and sq/n in the vertical direction. Then, the area-active drive processing section 15 divides the reduced-size image into (p×q) areas (step S13). Each area includes luminances for (s×s) pixels. Next, for each of the (p×q) areas, the area-active drive processing section 15 obtains a maximum value Ma of pixel luminances within that area and a mean value Me of pixel luminances within that area (step S14). Then, on the basis of the maximum value Ma and the mean value Me and so on obtained in step S14, the area-active drive processing section 15 obtains emission luminances of LEDs corresponding to each area (step S15). Note that the luminances obtained in step S15 will be referred to below as "first emission luminances".

Next, to overcome insufficient luminance and adjust image quality, the area-active drive processing section 15 performs a process (an emission luminance correction process) for correcting the first emission luminances to obtain second emission luminances (step S16). In the present embodiment, four luminance correction methods (hereinafter, referred to as "correction modes") are prepared for the emission luminance correction process. The correction from the first emission luminances to the second emission luminances is performed in accordance with a correction mode selected upon the emission luminance correction process (a selected correction mode). Note that the emission luminance correction process will be described in detail later.

Next, the area-active drive processing section 15 applies a luminance spread filter (dot spread filter) to the (p×q) second emission luminances obtained in step S16, thereby obtaining first backlight luminance data including (tp×tq) (where t is an integer of 2 or more) display luminances (step S17). In step S17, the (p×q) second emission luminances are scaled up by a factor of t in both in the horizontal and the vertical direction.

Next, the area-active drive processing section 15 performs a linear interpolation process on the first backlight luminance data, thereby obtaining second backlight luminance data including (m×n) display luminances (step S18). In step S18, the first backlight luminance data is scaled up by a factor of (m/tp) in the horizontal direction and a factor of (n/tq) in the horizontal direction. The second backlight luminance data represents luminances of backlight lights for color component C that enter (m×n) display elements 21 for color component c when (p×q) LEDs for color component c emit lights at the second emission luminances obtained in step S16.

Next, the area-active drive processing section 15 divides the luminances of the (m×n) pixels included in the input image for color component c respectively by the (m×n) display luminances included in the second backlight luminance data, thereby obtaining light transmittances T of the (m×n) display elements 21 for color component C (step S19).

Finally, for color component c, the area-active drive processing section 15 outputs liquid crystal data 32 representing the (m×n) light transmittances T obtained in step S19, and LED data 33 representing the (p×q) second emission luminances obtained in step S16 (step S20). At this time, the liquid crystal data 32 and the LED data 33 are converted to values within appropriate ranges in conformity with the specifications of the panel driver circuit 12 and the backlight driver circuit 14.

The area-active drive processing section 15 performs the process shown in FIG. 4 on an R image, a G image, and a B image, thereby obtaining liquid crystal data 32 representing (m×n×3) transmittances and LED data 33 representing (p×q×3) second emission luminances, on the basis of an input image 31 including luminances of (m×n×3) pixels.

Figure 5:
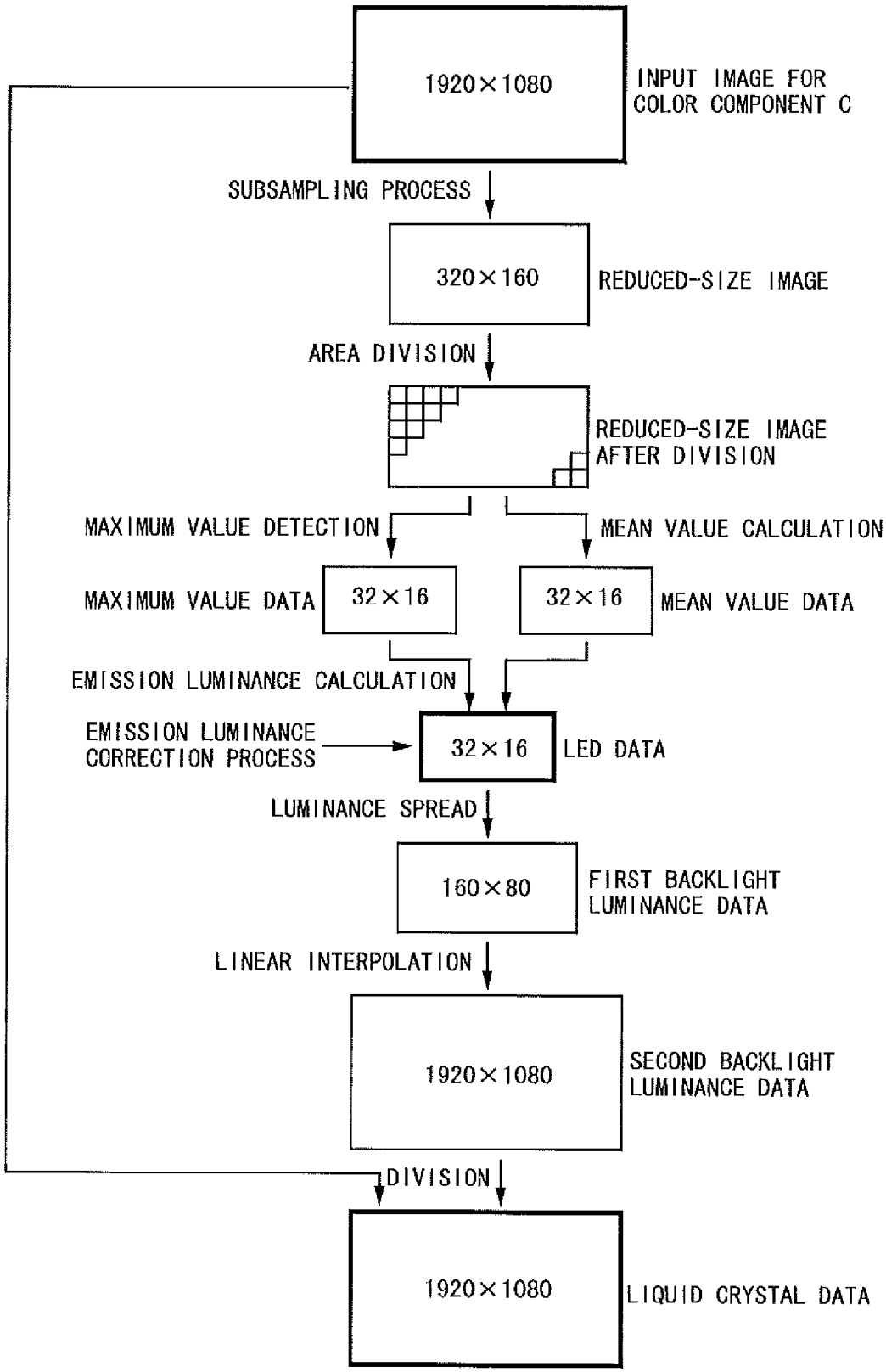
FIG. 5 is a diagram showing the course of action up to obtaining liquid crystal data and LED data in the embodiment.

FIG. 5 is a diagram showing the course of action up to obtaining liquid crystal data 32 and LED data 33 where m=1920, n=1080, p=32, q=16, s=10, and t=5. As shown in FIG. 5, a subsampling process is performed on an input image for color component c, which includes luminances of (1920×1080) pixels, thereby obtaining a reduced-size image including luminances of (320×160) pixels. The reduced-size image is divided into (32×16) areas (the size of each area is (10×10) pixels). By calculating the maximum value Ma and the mean value Me of the pixel luminances for each area, maximum value data including (32×16) maximum values and mean value data including (32×16) mean values are obtained. Then, on the basis of the maximum value data, the mean value data, etc., (32×16) emission luminances (first emission luminances) are obtained. The first emission luminances are corrected by the emission luminance correction process to obtain LED data 33 for color component c, which represents (32×16) emission luminances (second emission luminances).

By applying the luminance spread filter to the LED data 33 for color component c, first backlight luminance data including (160×80) luminances is obtained, and by performing a linear interpolation process on the first backlight luminance data, second backlight luminance data including (1920×1080) luminances is obtained. Finally, by dividing the pixel luminances included in the input image by the luminances included in the second backlight luminance data, liquid crystal data 32 for color component c, which includes (1920×1080) light transmittances, is obtained.

Note that in FIGS. 4 and 5, for ease of explanation, the area-active drive processing section 15 sequentially performs the process on images for color components, but the process may be performed on the images for color components in a time-division manner. Furthermore, in FIGS. 4 and 5, the area-active drive processing section 15 performs a subsampling process on an input image for noise removal and performs area-active drive on the basis of a reduced-size image, but the area active drive may be performed on the basis of the original input image.

<2 Configuration of the Area-Active Drive Processing Section>

Figure 1:
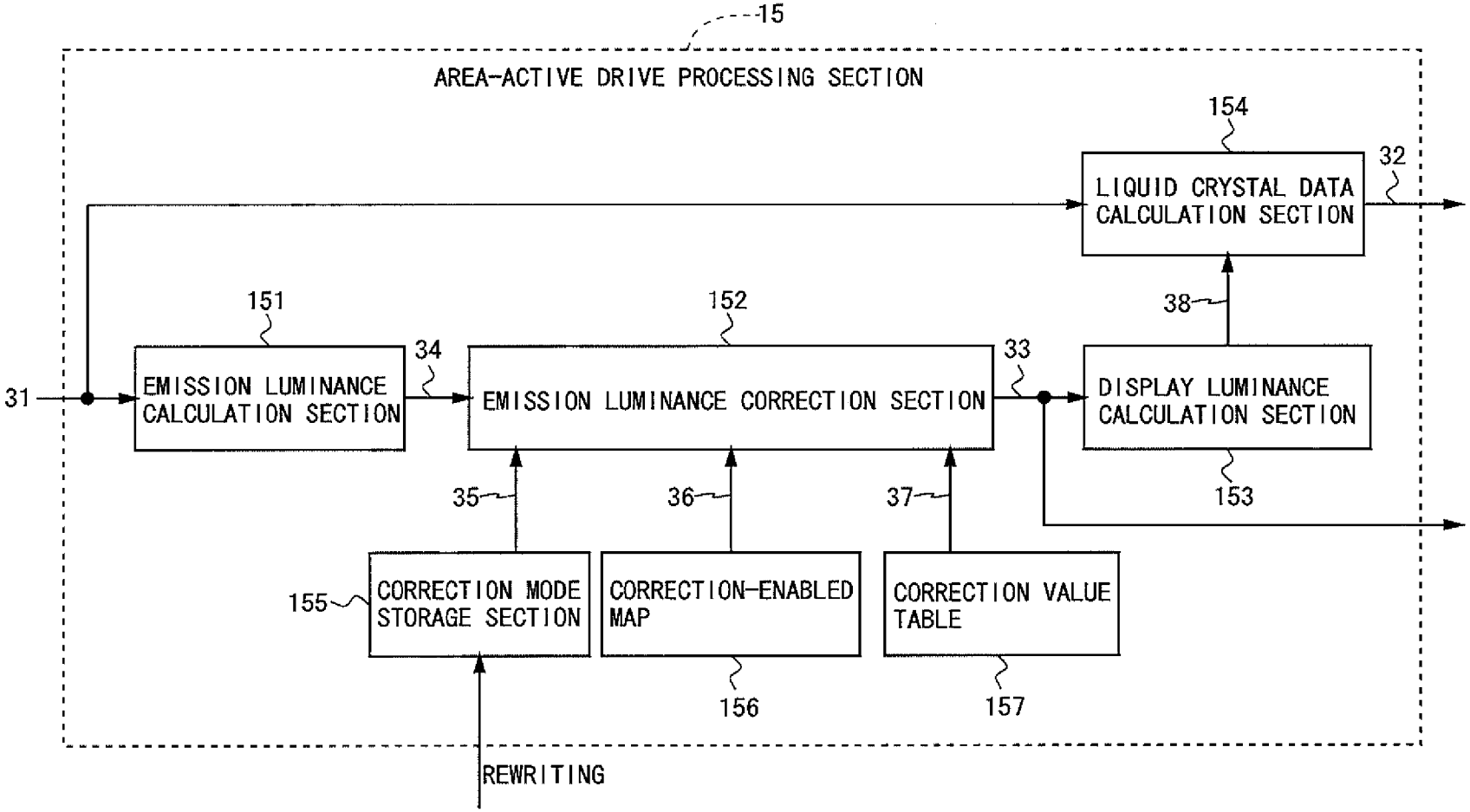
FIG. 1 is a block diagram illustrating a detailed configuration of an area-active drive processing section in an embodiment of the present invention.

FIG. 1 is a block diagram illustrating a detailed configuration of the area-active drive processing section 15 in the present embodiment. The area-active drive processing section 15 includes, as components for performing a predetermined process, an emission luminance calculation section 151, an emission luminance correction section 152, a display luminance calculation section 153, and a liquid crystal data calculation section 154. The area-active drive processing section 15 also includes, as components for storing predetermined data, a correction mode storage section 155, a correction-enabled map 156, and correction value tables 157. Note that in the present embodiment, the display luminance calculation section 153 and the liquid crystal data calculation section 154 realize a display data calculation section, the correction value table realizes a correction value storage section, the correction-enabled map realizes a correctability data storage section.

The emission luminance calculation section 151 divides an input image 31 into a plurality of areas, and obtains emission luminances of LEDs corresponding to the areas on the basis of the input image 31. Examples of the method for calculating the emission luminances include a method that makes a determination on the basis of a maximum pixel luminance Ma within each area, a method that makes a determination on the basis of a mean pixel luminance Me within each area, and a method that makes a determination on the basis of a value obtained by calculating a weighted mean of the maximum pixel luminance Ma and the mean pixel luminance Me within each area. The emission luminances obtained by the emission luminance calculation section 151 are provided to the emission luminance correction section 152 as the aforementioned first emission luminances 34.

The correction mode storage section 155 stores a correction mode (selected correction mode) 35 which indicates an emission luminance correction method to be performed by the emission luminance correction section 152. In the present embodiment, any numerical value of from 1 to 4 is stored to the correction mode storage section 155 at each time point. Note that the correction mode 35 stored in the correction mode storage section 155 is rewritten from outside the area-active drive processing section 15 in accordance with the content of the input image 31 (e.g., whether it is a moving or still image), the usage state of the liquid crystal display device 10, the settings by the user, and so on.

The correction-enabled map 156 has stored therein flag data (correctability data) 36 for each LED unit 22, which indicates whether or not emission luminances should be corrected by the emission luminance correction process. In the present embodiment, emission luminances are corrected for any LED units 22 whose flag data 36 has the value of 1, and emission luminances are not corrected for any LED units 22 whose flag data 36 has the value of 0. Here, it is assumed that the LED units 22 are provided as the backlight 13, such that eight of them are included in each row, and four of them are included in each column (in FIG. 3, p=8, and q=4). In addition, it is assumed that, when the panel is viewed as a plane, coordinates at the upper left corner are such that (x,y)=(0,0). In this case, the correction-enabled map 156 is, for example, as shown in FIG. 6. In the example shown in FIG. 6, emission luminances are not corrected for the LED units 22 arranged in the first (y=0) and fourth (y=3) rows, and emission luminances are corrected for the LED units 22 arranged in the second (y=1) and third (y=2) rows.

The correction value tables 157 have stored therein values to be referenced by the emission luminance correction section 152 upon calculation of the second emission luminances 33. While the LED units 22 include red LEDs 23, green LEDs 24, and blue LEDs 25, as described above, the correction value tables 157 are provided for their respective LED colors. Specifically, three correction value tables 157 are provided for red, green, and blue, respectively, as shown in FIG. 7. Alternatively, correction value tables 157 may be provided for their respective colors and correction modes, such that different correction value tables 157 are referenced in accordance with correction modes. Note that data stored in the correction value tables 157 will be referred to below as "correction value data".

For any LED units 22 whose flag data 36 stored in the correction-enabled map 156 has the value of 1, the emission luminance correction section 152 corrects their first emission luminances 34 to obtain second emission luminances 33 in accordance with the correction mode (selected correction mode) 35 stored in the correction mode storage section 155, with reference to the correction value data 37 stored in the correction value tables 157. Note that for any LED units 22 whose emission luminances are not to be corrected by the emission luminance correction process, the values for their first emission luminances 34 are set as second emission luminances 33 without modification.

Data indicating the second emission luminances 33 obtained by the emission luminance correction section 152 is provided to both the backlight driver circuit 14 and the display luminance calculation section 153 as LED data 33. The display luminance calculation section 153 obtains display luminances 38 for all display elements 21 included in the liquid crystal panel 11, on the basis of the LED data (second emission luminances) 33. The liquid crystal data calculation section 154 obtains liquid crystal data 32 representing light transmittances for all of the display elements 21 included in the liquid crystal panel 11, on the basis of the input image 31 and the display luminances 38.

<3 Emission Luminance Correction Process>

Hereinafter, the emission luminance correction process in the present embodiment will be described in detail. Note that it is assumed here that LED units 22 are provided such that eight of them are included in each row, and four of them are included in each column, in the same manner as above, and the LED units 22 are assigned their respective unique numbers (LED numbers) as shown in FIG. 8. For example, the LED unit 22 arranged at coordinates (x,y)=(3,0) has the LED number "3", and the LED unit 22 arranged at coordinates (x,y)=(5,3) has the LED number "29".

The emission luminance correction section 152 initially acquires flag data 36 for each LED unit 22 from the correction-enabled map 156. Then, for any LED units 22 (red LEDs 23, green LEDs 24, and blue LEDs 25) whose flag data 36 has the value of 0, the emission luminance correction section 152 sets the values for their first emission luminances 34 as second emission luminances 33 without modification. Next, the emission luminance correction section 152 acquires a correction mode 35 stored in the correction mode storage section 155. Then, for any LED units 22 (red LEDs 23, green LEDs 24, and blue LEDs 25) whose flag data 36 has the value of 1, the emission luminance correction section 152 performs a correction to be described later (a correction from first emission luminances 34 to second emission luminances 33), in accordance with the correction mode 35. Note that in the present embodiment, four correction modes are provided, including a first correction mode (correction mode=1), a second correction mode (correction mode=2), a third correction mode (correction mode=3), and a fourth correction mode (correction mode=4).

Hereinafter, referring to FIGS. 9 to 12, the details of the correction process will be described for each correction mode. Note that in each of FIGS. 9 to 12, the upper left graph schematically illustrates the value of the first emission luminance 34 for each LED, the upper right graph schematically illustrates the value of the correction value data 37 stored in the correction value table 157 for each LED, and the bottom graph schematically illustrates the value of the second emission luminance 33 obtained for each LED by the emission luminance correction process. Note that in FIGS. 9 to 12, only the LEDs with LED numbers 0 to 8 are shown. In the descriptions below, the following definitions are used.

(x,y): coordinates for the position of an LED. Here, coordinates at the upper left corner when the panel is viewed as a plane are set as (0,0).

c: color component. For example, "c=0" represents red, "c=1" represents green, and c=2" represents blue.

Vo(x,y,c): the value for the first emission luminance 34 of an LED for color component c within the LED unit 22 arranged at coordinates (x,y).

Vc(x,y,c): the value for the second emission luminance 33 of an LED for color component c within the LED unit 22 arranged at coordinates (x,y).

Vmax: maximum luminance (maximum possible emission luminance of an LED). Note that in FIGS. 9 to 12, for convenience of explanation, the maximum luminance is set at 10.

Vmin: minimum luminance. Typically, the minimum luminance is "0", which indicates off state.

O(x,y,c): the value for the correction value data 37 of an LED for color component c within the LED unit 22 arranged at coordinates (x,y). Note that this value is set within the range from Vmin to Vmax.

Max (a,b): a function for acquiring the value for the greater of a and b.

Min (a,b): a function for acquiring the value for the lesser of a and b.

<3.1 First Correction Mode>

Where "correction mode=1", the emission luminance correction section 152 obtains the second emission luminance 33 for each LED by equation (1) below.

$$Vc(x,y,c)=\mathrm{Max}(Vo(x,y,c),O(x,y,c)) \quad (1)$$

As can be appreciated from equation (1), for each LED, the greater of the value for the first emission luminance 34 and the value for the correction value data 37 stored in the correction value table 157 is set as the second emission luminance 33.

Figure 9:
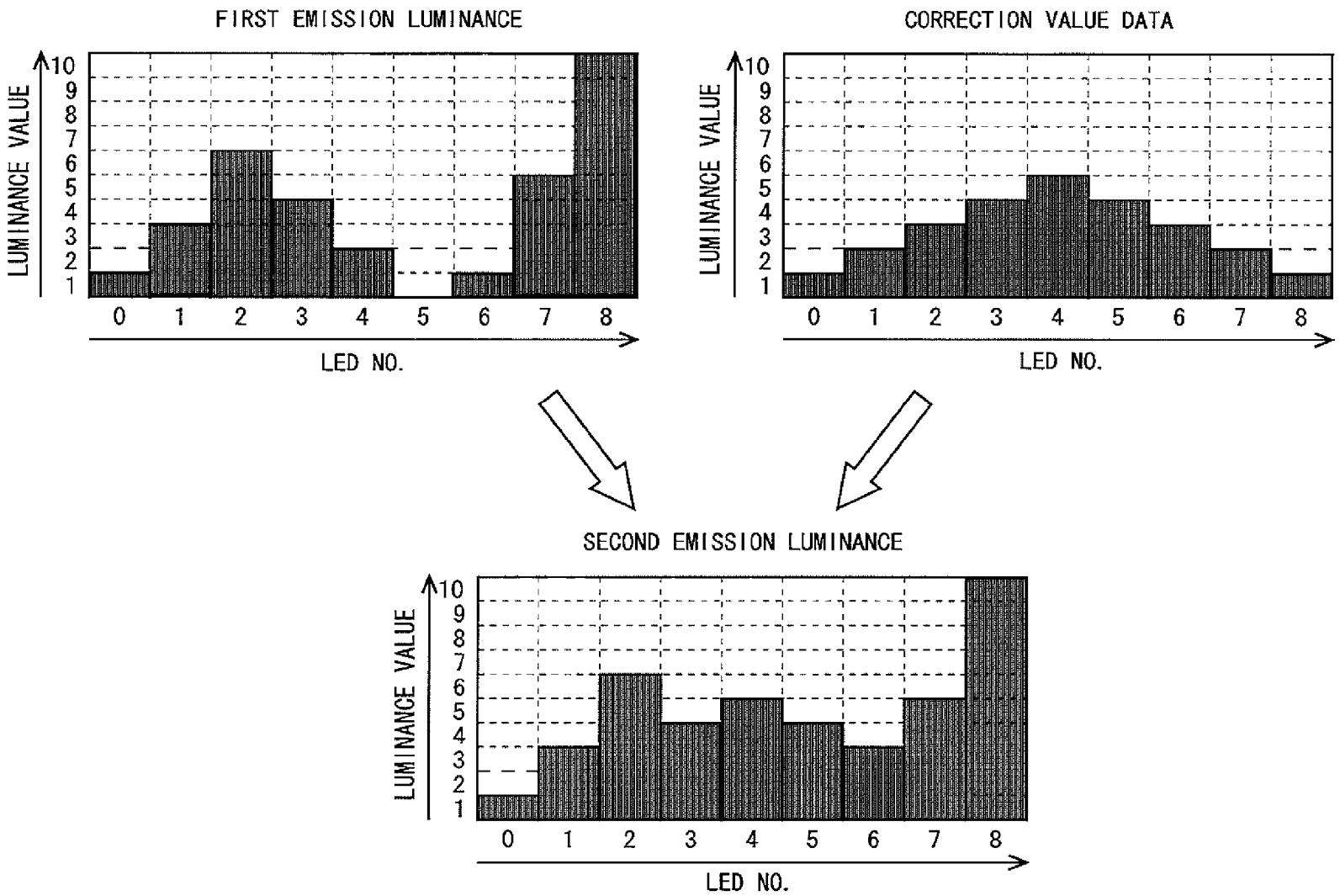
FIG. 9 is a diagram describing a correction process by a first correction mode in the embodiment.

For example, it is assumed that, for certain LEDs for color component c, the first emission luminances 34 are calculated as shown in the upper left graph of FIG. 9, and the correction value data 37 is stored in the correction value table 157 as shown in the upper right graph of FIG. 9. Here, looking at data with "LED number=4", the value for the first emission luminance 34 is "2", and the value for the correction value data 37 is "5". Since the value for the correction value data 37 is greater than the value for the first emission luminance 34, the second emission luminance 33 of the LED with "LED number=4" is set at "5", which is the value for the correction value data 37. Also, looking at data with "LED number=8", the value for the first emission luminance 34 is "10", and the value for the correction value data 37 is "1". Since the value for the first emission luminance 34 is greater than the value for the correction value data 37, the second emission luminance 33 of the LED with "LED number=8" is set at "10", which is the value for the first emission luminance 34. In this manner, the second emission luminances 33 obtained by the emission luminance correction section 152 are as shown in the bottom graph of FIG. 9.

<3.2 Second Correction Mode>

Where "correction mode=2", the emission luminance correction section 152 obtains the second emission luminance 33 for each LED by equation (2) below.

$$Vc(x,y,c)=\mathrm{Min}(V\mathrm{max},Vo(x,y,c)+O(x,y,c)) \quad (2)$$

As can be appreciated from equation (2), for each LED, the lesser of the maximum luminance and a value obtained by adding the value for the correction value data 37 to the value for the first emission luminance 34 is set as the second emission luminance 33. In other words, for each LED, a value obtained by adding the value for the correction value data 37 to the value for the first emission luminance 34 is set as the second emission luminance 33 where the obtained value has its upper limit at the maximum possible emission luminance of the LED.

Figure 10:
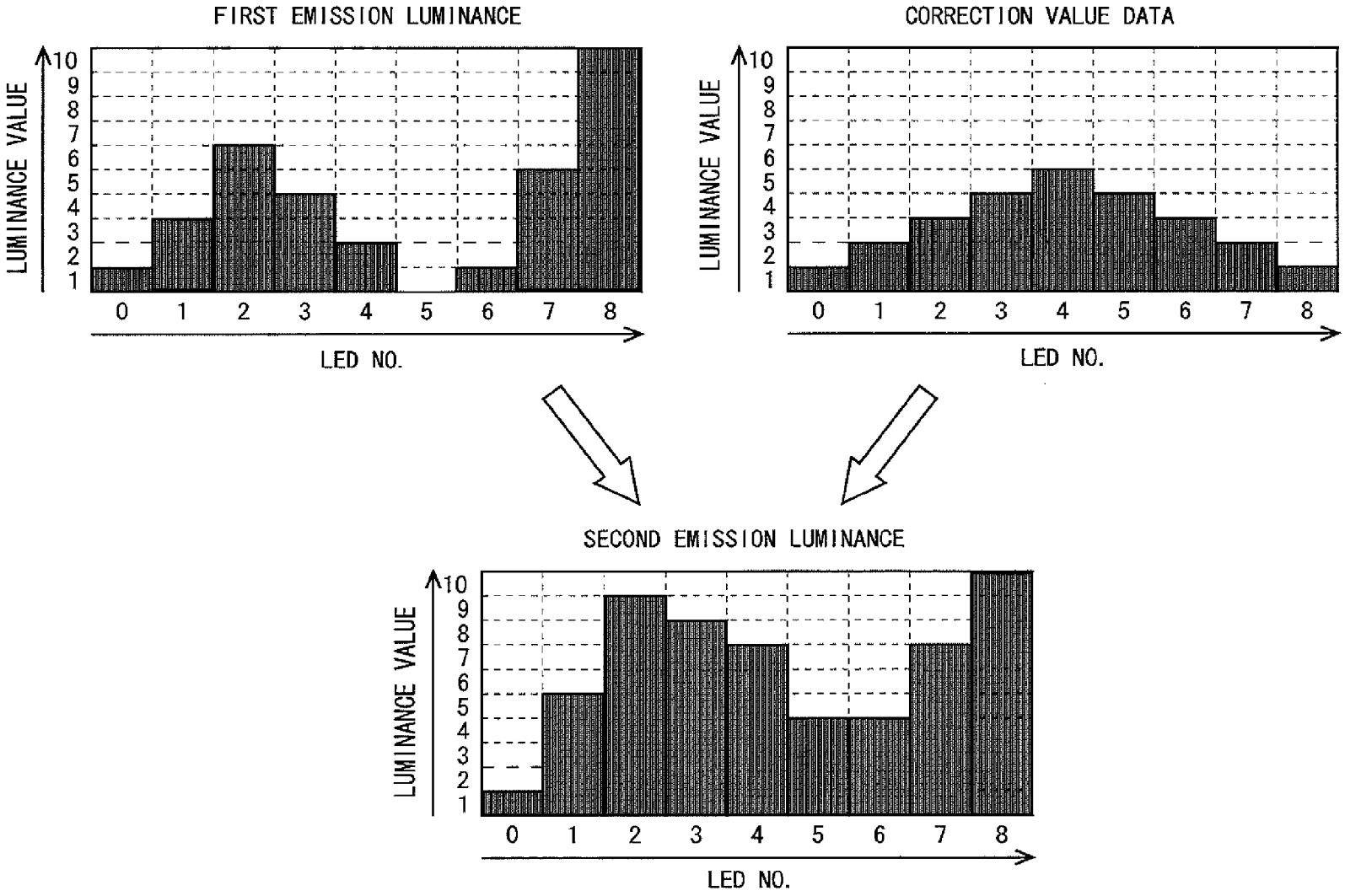
FIG. 10 is a diagram describing a correction process by a second correction mode in the embodiment.

For example, it is assumed that, for certain LEDs for color component c, the first emission luminances 34 are calculated as shown in the upper left graph of FIG. 10, and the correction value data 37 is stored in the correction value table 157 as shown in the upper right graph of FIG. 10. Here, looking at data with "LED number=1", the value for the first emission luminance 34 is "3", and the value for the correction value data 37 is "2". The sum of the value for the first emission luminance 34 and the value for the correction value data 37 is "5", which is less than the maximum luminance, "10". Accordingly, for the LED with "LED number=1", the second emission luminance 33 is set at "5". Also, looking at data with "LED number=8", the value for the first emission luminance 34 is "10", and the value for the correction value data 37 is "1". The sum of the value for the first emission luminance 34 and the value for the correction value data 37 is "11", and the maximum luminance, "10", is less than "11". Accordingly, for the LED with "LED number=8", the second emission luminance 33 is set at "10". In this manner, the second emission luminances 33 obtained by the emission luminance correction section 152 are as shown in the bottom graph of FIG. 10.

<3.3 Third Correction Mode>

Where "correction mode=3", the emission luminance correction section 152 obtains the second emission luminance 33 for each LED by equation (3) below.

$$Vc(x,y,c)=O(x,y,c) \quad (3)$$

As can be appreciated from equation (3), for each LED, the value for the correction value data 37 stored in the correction value table 157 is set as the second emission luminance 33 without modification.

Figure 11:
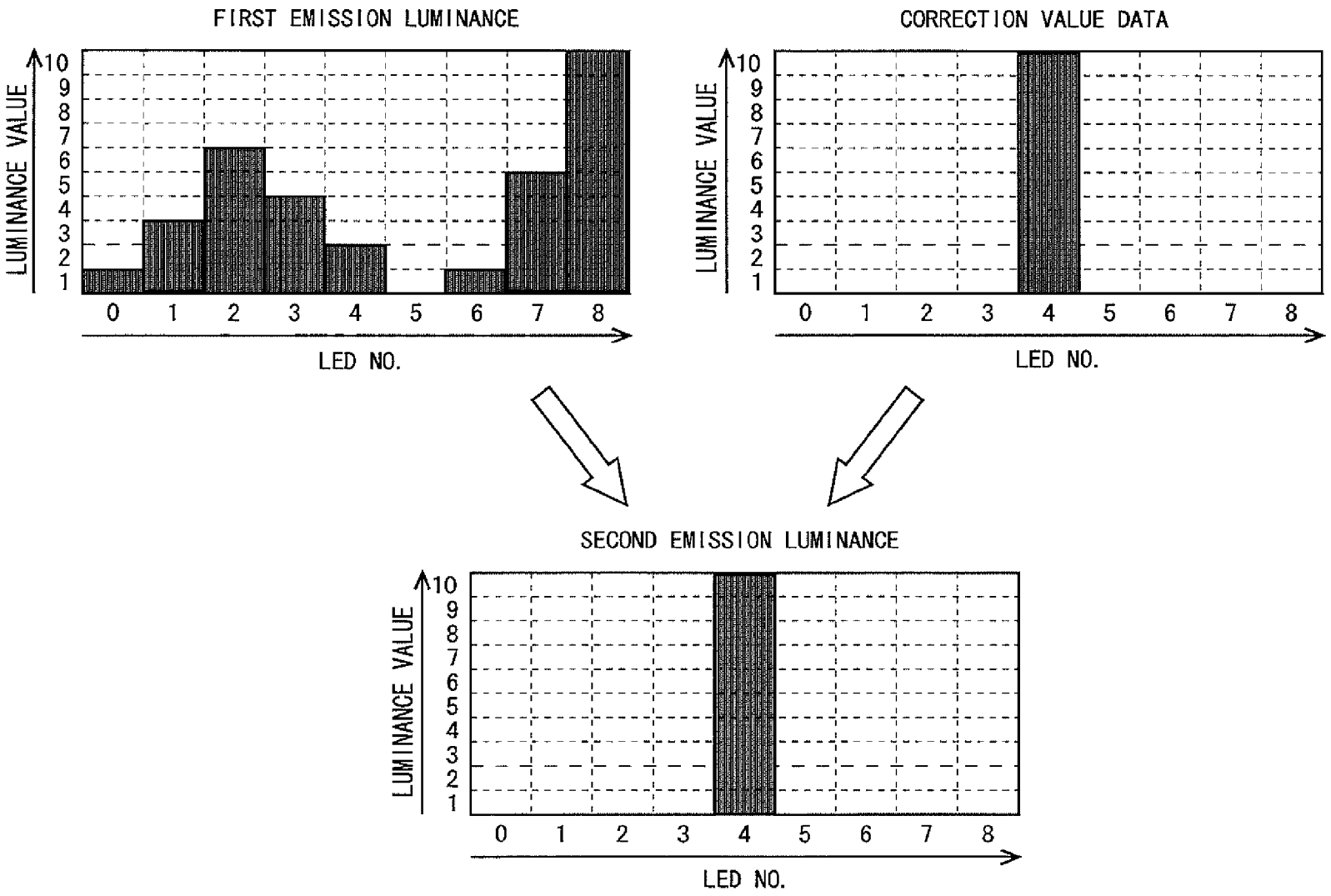
FIG. 11 is a diagram describing a correction process by a third correction mode in the embodiment.

For example, it is assumed that, for certain LEDs for color component c, the first emission luminances 34 are calculated as shown in the upper left graph of FIG. 11, and the correction value data 37 is stored in the correction value table 157 as shown in the upper right graph of FIG. 11. In the case of the third correction mode, the values for the correction value data 37 are set as the second emission luminances 33 regardless of the values for the first emission luminances 34, and therefore, the second emission luminances 33 obtained by the emission luminance correction section 152 are as shown in the bottom graph of FIG. 11.

<3.4 Fourth Correction Mode>

Where "correction mode=4", the emission luminance correction section 152 obtains the second emission luminance 33 for each LED by equation (4) below.

$$V_c(x,y,c)=V_o(x,y,c) \quad (4)$$

As can be appreciated from equation (4), for each LED, the value for the first emission luminance 34 is set as the second emission luminance 33 without modification.

Figure 12:
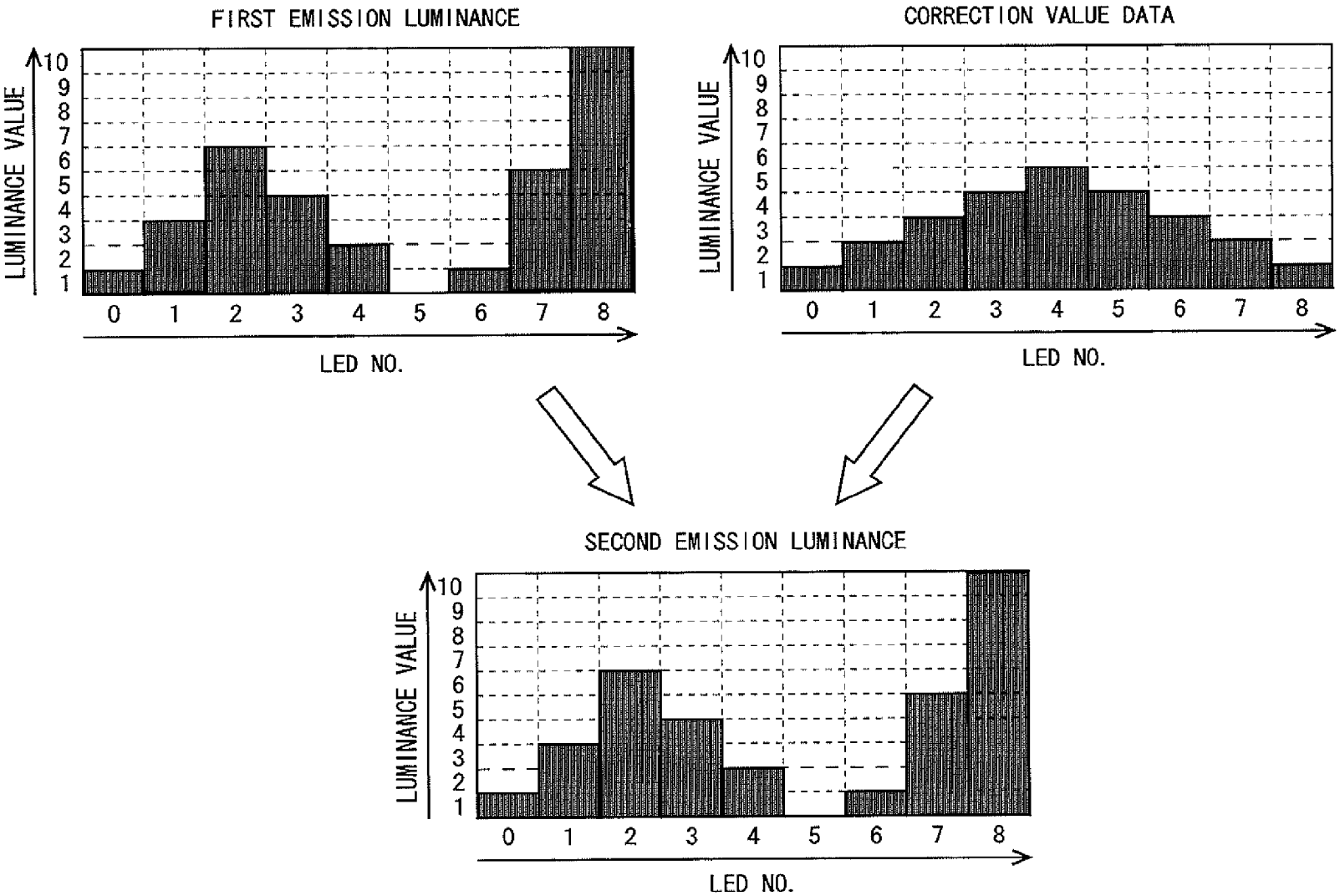
FIG. 12 is a diagram describing a correction process by a fourth correction mode in the embodiment.

For example, it is assumed that, for certain LEDs for color component c, the first emission luminances 34 are calculated as shown in the upper left graph of FIG. 12, and the correction value data 37 is stored in the correction value table 157 as shown in the upper right graph of FIG. 12. In the case of the fourth correction mode, the values for the first emission luminances 34 are set as the second emission luminances 33 without modification, regardless of the values for the correction value data 37, and therefore, the second emission luminances 33 obtained by the emission luminance correction section 152 are as shown in the bottom graph of FIG. 12.

<4. Effect>

In the present embodiment, in the liquid crystal display device which performs area-active drive, an emission luminance (first emission luminance) obtained for each area on the basis of a luminance distribution for an input image is corrected by a correction mode which is selected from among four prepared correction modes in accordance with the details of the input image 31, the usage state of the liquid crystal display device 10, and so on. Accordingly, unlike in the conventional correction method where a luminance equivalent to a predetermined offset amount is uniformly added to each of the values for emission luminances of all LEDs, emission luminances can be corrected in a more flexible manner. In addition, by providing the correction-enabled map 156, it is possible to determine for each area whether or not to correct its emission luminance. Thus, for example, it is possible to determine the emission luminance not to be corrected for any LEDs in the areas that are to be displayed in black, so that unnecessary power consumption can be inhibited, and reduction of image quality due to impure black can be inhibited.

Figures 13, 14:
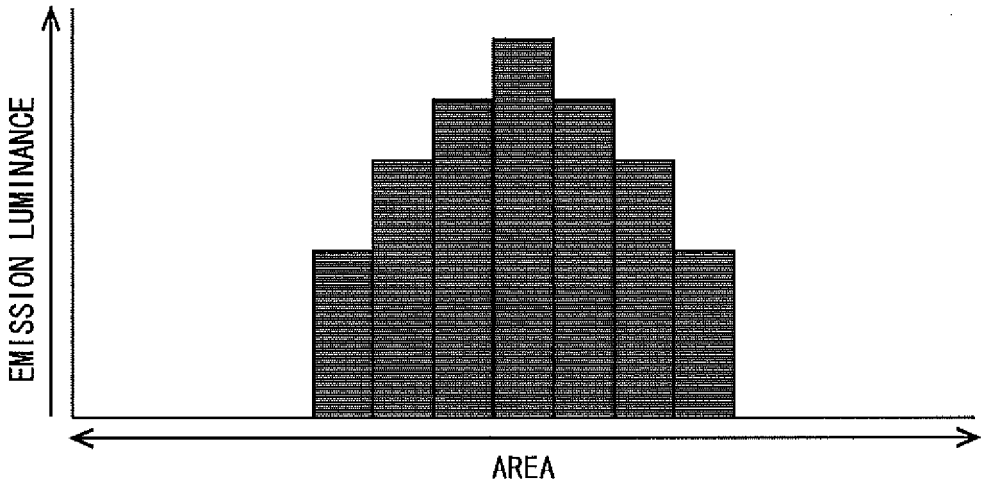
FIG. 13 is a diagram describing an effect of the embodiment.
FIG. 14 is a diagram describing a process for correcting emission luminances to overcome insufficient luminance when only one area is lit up.
Figure 16:
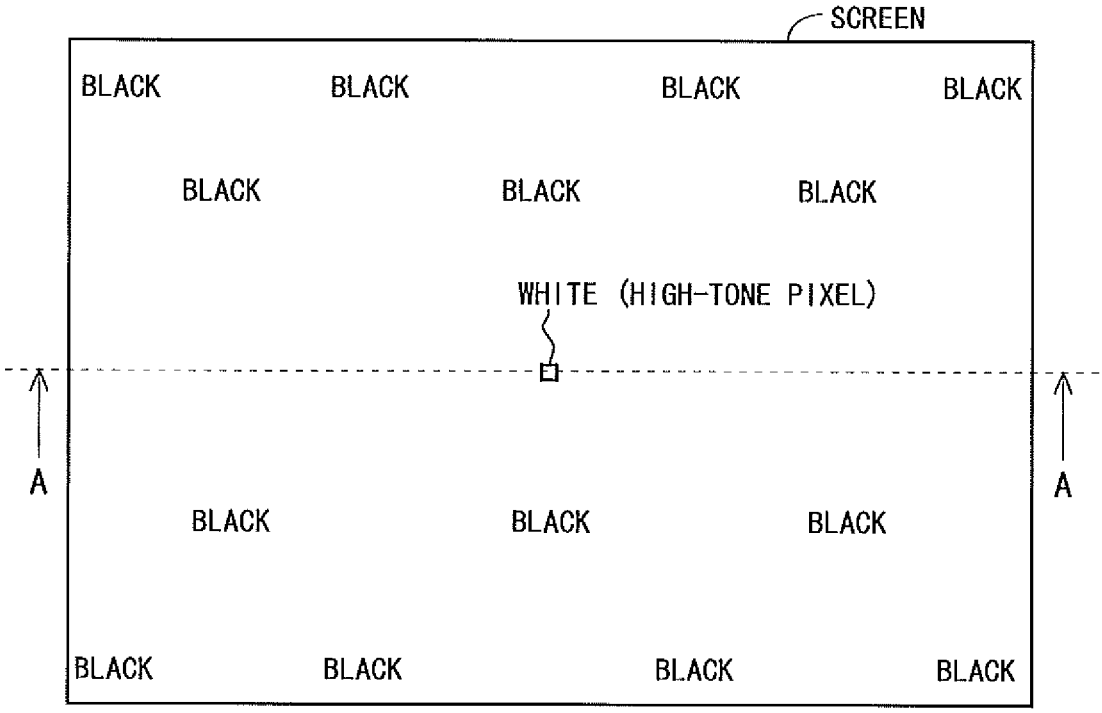
FIG. 16 is a diagram schematically illustrating an image which represents "a state where only one star is shining in the night sky".
Figure 17:
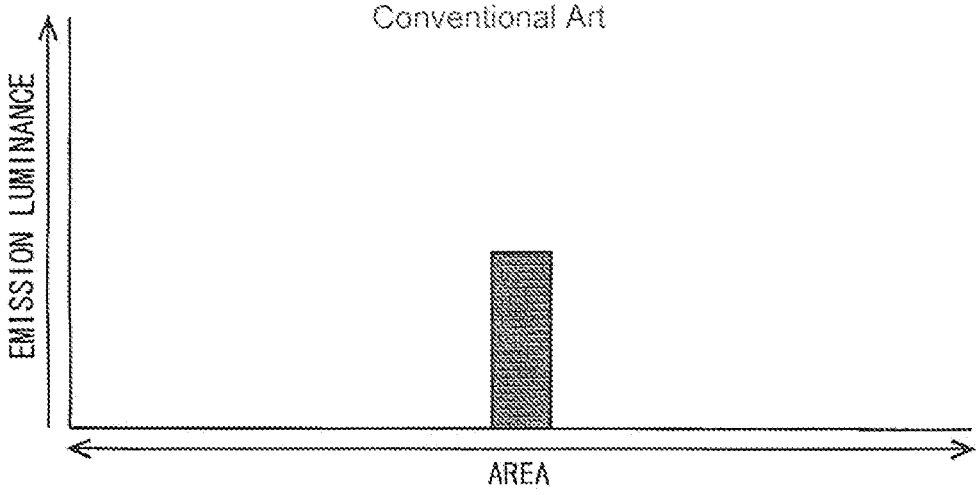
Fig.17 Conventional Art
FIG. 17 is a diagram describing the conventional art.
Figure 18:
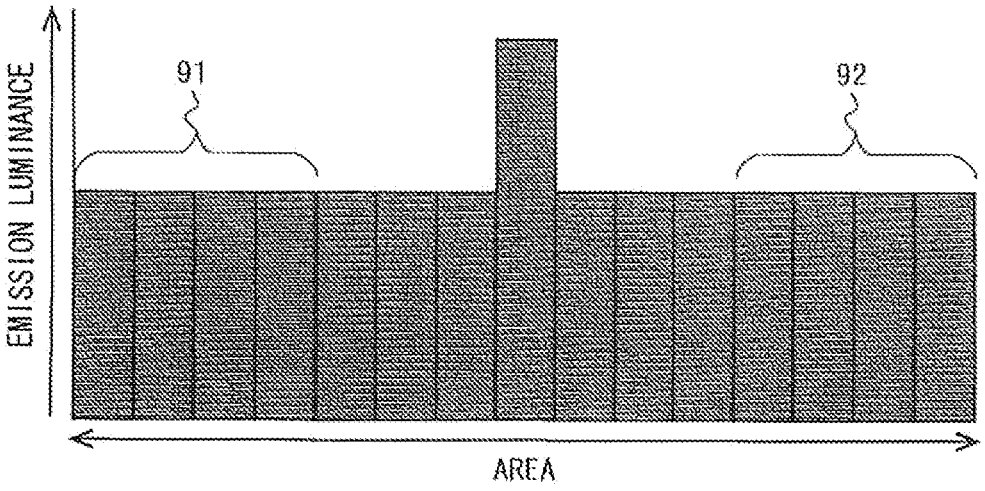
Fig.18 Conventional Art
FIG. 18 is a diagram describing the conventional art.

Furthermore, by providing the first correction mode, the following effects can be achieved. As for the correction value table 157, for example, the values of the correction value data 37 for LEDs corresponding to the center of the panel and its surrounding portions can be set as relatively large values. When such a setting is made, in the center of the panel and its surrounding portions, the LEDs emit light reliably with a predetermined luminance or higher. As a result, satisfactory image quality is maintained in the center of the panel and its surrounding portions. For example, in the case where an image as shown in FIG. 16 (an image which represents "a state where only one star is shining in the night sky") is displayed, the conventional emission luminance correction process results in emission luminances for areas along line A-A of FIG. 16 as shown in FIG. 18. On the other hand, the first correction mode of the present embodiment can achieve the emission luminances for areas along line A-A of FIG. 16 as shown in FIG. 13. That is, individual LEDs are allowed to emit light with more appropriate luminances. Moreover, as for the correction value table 157, for example, the values of the correction value data 37 for LEDs corresponding to the edge of the panel and its surrounding portions can be set as relatively large values. When such a setting is made, at the edge of the panel and its surrounding portions, the LEDs emit light reliably with a predetermined luminance or higher. As a result, it is possible to prevent insufficient luminance from occurring at the edge of the panel and its surrounding portions. In this manner, upon emission luminance correction, a minimum required emission luminance can be determined for each LED, rather than a luminance equivalent to a common offset amount being added to each of the values for the emission luminances of all LEDs. Moreover, for any LEDs to which their values for the correction value data 37 are applied as the second emission luminances 33, their luminances are not increased unnecessarily, and the LEDs emit light with their minimum possible luminances that do not cause insufficient luminance. Thus, when compared to the conventional configuration, power consumption can be reduced more effectively. In addition, when compared to the second correction mode where a value obtained by adding the value for the first emission luminance 34 and the value for the correction value data 37 is set as the second emission luminance 33, the contrast ratio within the panel is inhibited from being reduced.

Furthermore, by providing the second correction mode, the following effects can be achieved. First, as in the case of the first correction mode, it is possible to ensure that satisfactory image quality is maintained in the center of the panel and its surrounding portions, and insufficient luminance is prevented from occurring at the edge of the panel and its surrounding portions. In this manner, upon emission luminance correction, a luminance equivalent to a different offset amount can be added to the value for an emission luminance of each LED, rather than a luminance equivalent to a common offset amount being added to each of the values for the emission luminances of all LEDs. In addition, for all LEDs, their second emission luminances 33 can be calculated by adding luminances, which are equal to offset amounts determined for their respective LEDs, to the first emission luminances 34, except in the case where the maximum luminance is exceeded (in the case of the first correction mode, there are LEDs for which their luminances are added to the first emission luminances 34 and LEDs for which no luminance is added). As a result, a satisfactory luminance balance is maintained across the entire panel, and the emission luminance of each LED is increased. Thus, it is possible to inhibit any halo (image blurring) phenomenon or suchlike from occurring due to the difference in luminance between LEDs.

Furthermore, by providing the third correction mode, the following effects can be achieved. In general, when a CinemaScope size image (e.g., an image in which the size of width is more than twice the size of height, such that "height: width=1:2.35") is displayed on a full HD display device, black strips (rectangular non-display portions) appear on the top and the bottom of the panel. It is not necessary to light up LEDs for such black strips. Accordingly, the correction value table 157 is prepared in which the correction value data 37 for the LEDs that correspond to the black strips is set at the value of "0", and the third correction mode is employed as an emission luminance correction method, so that the LEDs that correspond to the black strips can be set in off state. In this manner, LEDs that are not required to be lit up can be forcibly set in off state, resulting in reduced power consumption. Moreover, for example, when an OSD menu (a menu for the user to set contrast, brightness, etc., of the display) is displayed, LEDs in the portion that corresponds to the display position of the OSD menu can be caused to emit light with a higher luminance. In this manner, when a specific image that is to be provided with high luminance is displayed, the image can be rendered conspicuous by increasing the luminance of the LEDs that correspond to the image portion. Moreover, when a luminance distribution is measured, it is possible to generate luminance data such that only the LEDs in (arbitrarily) designated positions are lit up with (arbitrarily) designated luminances. Thus, it is possible to readily create a desired environment for development, and thereby to enhance development efficiency.

Furthermore, by providing the fourth correction mode, the following effects can be achieved. In general, when the emission luminance of each LED is increased by the emission luminance correction process, insufficient luminance and the aforementioned halo phenomenon or suchlike are inhibited. However, an increase of the minimum LED luminance might result in a reduced contrast ratio within the panel. Therefore, by employing the fourth correction mode when performing image display with an enhanced contrast ratio, it is rendered possible to prevent reduction of the contrast ratio. For example, in the case of a liquid crystal television provided with an image position for enhanced contrast ratio, this mode may be applied upon selection of the image position.

Here, the four correction modes to be employed in the emission luminance correction process are switched from one to another on the basis of numerical data stored in the correction mode storage section 155. Thus, the emission luminance correction method can be easily changed in accordance with matters considered to be important for image display.

<5. Variants and Others>

While the above embodiment has been described taking the liquid crystal display device as an example, the present invention is not limited to this. By performing the aforementioned emission luminance correction process in any image display device provided with a backlight, the same effects as those achieved by the liquid crystal display device can be achieved.

In addition, while four correction modes are provided in the above embodiment, including the first correction mode, the second correction mode, the third correction mode, and the fourth correction mode, the present invention is not limited to this. Any configuration may be employed so long as a plurality of correction modes are prepared and emission luminance correction is performed in accordance with a correction mode which is selected in the emission luminance correction process. For example, the configuration may be such that three correction modes are provided, including the first correction mode, the third correction mode, and the fourth correction mode, or including the second correction mode, the third correction mode, and the fourth correction mode.

Furthermore, while the backlight 13 in the embodiment consists of the red LEDs 23, the green LEDs 24, and the blue LEDs 25, the present invention is not limited to this. For example, the backlight 13 may consist of white LEDs, or may consist of LEDs of four or more colors. Note that in the case where the backlight 13 consists of white LEDs, a correction value table 157 corresponding to the white LEDs may be provided, and in the case where the backlight 13 consists of LEDs of four or more colors, correction value tables 157 respectively corresponding to the LEDs of four or more colors may be provided.

Figure 15:
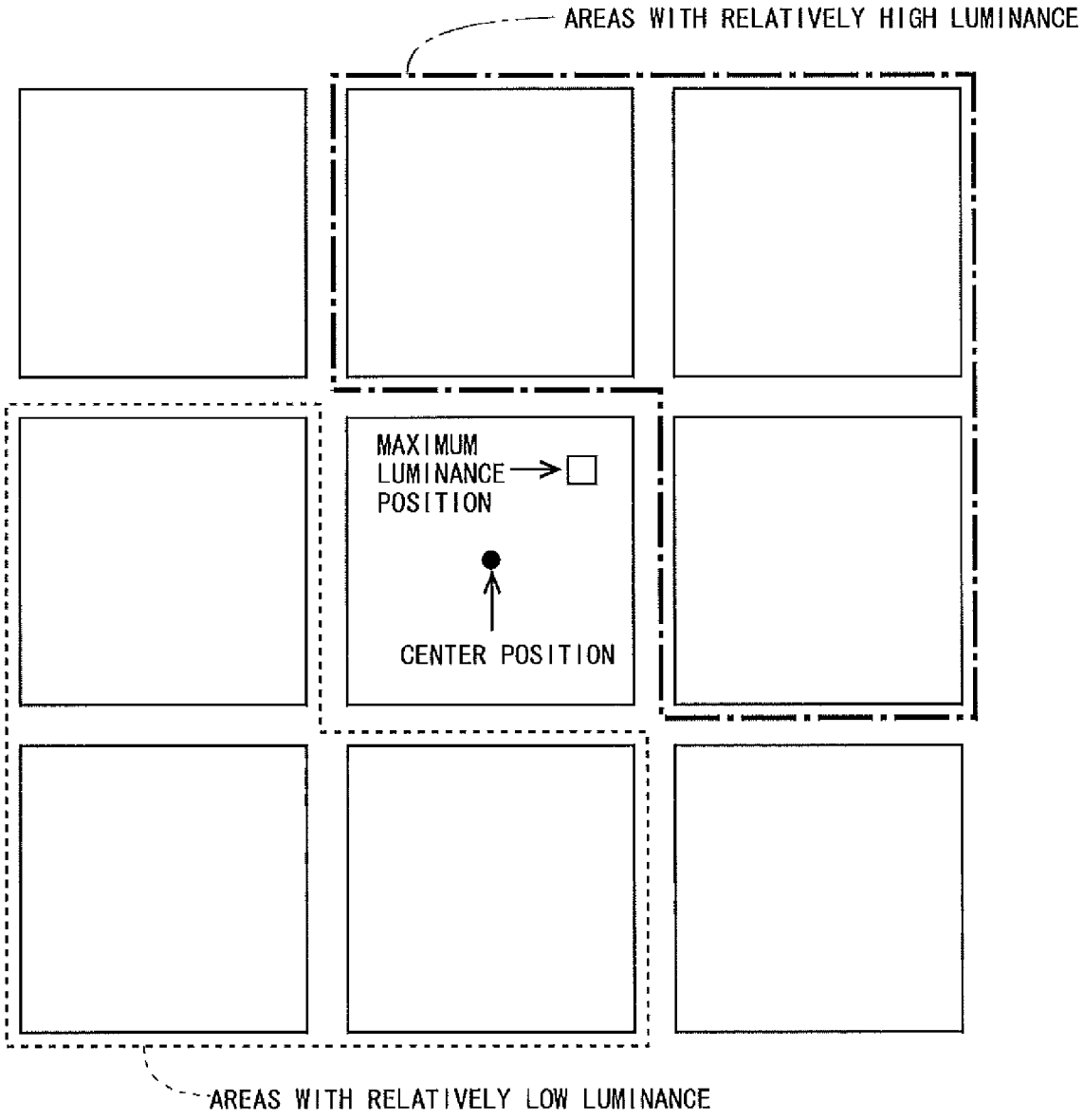
FIG. 15 is a diagram describing a process for correcting emission luminances in accordance with a maximum luminance position in each area.

Still furthermore, in addition to the aforementioned emission luminance correction process, the emission luminance correction section 152 may perform a process for correcting emission luminances to overcome insufficient luminance when only one area is lit up. In this case, assuming that the emission luminance for a given area is "100", and the emission luminance for other areas is "0", a filter is prepared indicating luminances with which LEDs in, for example, 25 areas around that given area emit light (see FIG. 14). Then, on the basis of the filter, emission luminances of LEDs in areas surrounding the lit-up area is increased. Moreover, in addition to the aforementioned emission luminance correction process, the emission luminance correction section 152 may perform a process for correcting emission luminances in accordance with the position of a pixel with the maximum luminance in each area (hereinafter, referred to as the "maximum luminance position"). In this case, emission luminances are set to be relatively high in areas on the same side as the maximum luminance position with respect to the center of the area, and emission luminances are set to be relatively low in areas on the opposite side to the maximum luminance position with respect to the center of the area (see FIG. 15).

DESCRIPTION OF THE REFERENCE CHARACTERS

10 liquid crystal display device
11 liquid crystal panel
12 panel driver circuit
13 backlight
14 backlight driver circuit
15 area-active drive processing section
21 display element
22 LED unit
31 input image
32 liquid crystal data
33 second emission luminance (LED data)
34 first emission luminance
35 correction mode
36 flag data
37 correction value data
38 display luminance
151 emission luminance calculation section
152 emission luminance correction section
153 display luminance calculation section
154 liquid crystal data calculation section
155 correction mode storage section
156 correction-enabled map
157 correction value table

The invention claimed is:

1. An image display device having a function of controlling a backlight luminance, comprising:

a display panel including a plurality of display elements;

a backlight including a plurality of light sources;

an emission luminance calculation section configured to divide an input image into a plurality of areas and obtaining luminances upon emission of light sources corresponding to each area as first emission luminances on the basis of a portion of the input image of a corresponding area;

an emission luminance correction section configured to obtain second emission luminances by correcting the first emission luminances in accordance with a selected correction mode which is selected from among a plurality of correction modes;

a display data calculation section configured to obtain display data for controlling light transmittances of the display elements, on the basis of the input image and the second emission luminances;

a panel driver circuit configured to output signals for controlling the light transmittances of the display elements to the display panel, on the basis of the display data; and a backlight driver circuit configured to output signals for controlling luminances of the light sources to the backlight, on the basis of the second emission luminances.

2. The image display device according to claim 1, further comprising a correction value storage section having stored therein correction values corresponding to the areas, wherein, the plurality of correction modes include a first correction mode in which, for each area, the greater of a value for the first emission luminance and the correction value stored in the correction value storage section is set as the second emission luminance.

3. The image display device according to claim 2, wherein the plurality of correction modes includes a third correction mode in which, for each area, the correction value stored in the correction value storage section is set as the second emission luminance, and a fourth correction mode in which, for each area, the value for the first emission luminance is set as the second emission luminance.

4. The image display device according to claim 1, further comprising a correction value storage section having stored therein correction values corresponding to the areas, wherein, the plurality of correction modes include a second correction mode in which, for each area, the lesser of a value for the maximum emission luminance of the light sources and a value obtained by adding a value for the first emission luminance to the correction value stored in the correction value storage section is set as the second emission luminance.

5. The image display device according to claim 1, further comprising a correction value storage section having stored therein correction values corresponding to the areas, wherein, the plurality of correction modes include a first correction mode in which, for each area, the greater of a value for the first emission luminance and the correction value stored in the correction value storage section is set as the second emission luminance, a second correction mode in which, for each area, the lesser of a value for the maximum emission luminance of the light sources and a value obtained by adding a value for the first emission luminance to the correction value stored in the correction value storage section is set as the second emission luminance, a third correction mode in which, for each area, the correction value stored in the correction value storage section is set as the second emission luminance, and a fourth correction mode in which, for each area, the value for the first emission luminance is set as the second emission luminance.

6. The image display device according to claim 1, further comprising a correctability data storage section having stored therein correctability data corresponding to the areas as data indicating whether or not to perform a correction in accordance with the selected correction mode, wherein, the emission luminance correction section sets the value for the first emission luminance as the second emission luminance for any area for which the correctability data stored in the correctability data storage section indicates that the correction in accordance with the selected correction mode is not performed.

7. An image display method in an image display device provided with a display panel including a plurality of display elements and a backlight including a plurality of light sources, the method comprising:

an emission luminance calculation step for dividing an input image into a plurality of areas and obtaining luminances upon emission of light sources corresponding to each area as first emission luminances on the basis of a portion of the input image of a corresponding area;

an emission luminance correction step for obtaining second emission luminances by correcting the first emission luminances in accordance with a selected correction mode which is selected from among a plurality of correction modes;

a display data calculation step for obtaining display data for controlling light transmittances of the display elements, on the basis of the input image and the second emission luminances;

a panel drive step for outputting signals for controlling the light transmittances of the display elements to the display panel, on the basis of the display data; and a backlight drive step for outputting signals for controlling luminances of the light sources to the backlight, on the basis of the second emission luminances.

8. The image display method according to claim 7, wherein, the image display device further includes a correction value storage section having stored therein correction values corresponding to the areas, and the plurality of correction modes include a first correction mode in which, for each area, the greater of a value for the first emission luminance and the correction value stored in the correction value storage section is set as the second emission luminance.

9. The image display method according to claim 8, wherein the plurality of correction modes includes a third correction mode in which, for each area, the correction value stored in the correction value storage section is set as the second emission luminance, and a fourth correction mode in which, for each area, the value for the first emission luminance is set as the second emission luminance.

10. The image display method according to claim 7, wherein, the image display device further includes a correction value storage section having stored therein correction values corresponding to the areas, and the plurality of correction modes include a second correction mode in which, for each area, the lesser of a value for the maximum emission luminance of the light sources and a value obtained by adding a value for the first emission luminance to the correction value stored in the correction value storage section is set as the second emission luminance.

11. The image display method according to claim 7, wherein, the image display device further includes a correction value storage section having stored therein correction values corresponding to the areas, and the plurality of correction modes include a first correction mode in which, for each area, the greater of a value for the first emission luminance and the correction value stored in the correction value storage section is set as the second emission luminance, a second correction mode in which, for each area, the lesser of a value for the maximum emission luminance of the light sources and a value obtained by adding a value for the first emission luminance to the correction value stored in the correction value storage section is set as the second emission luminance, a third correction mode in which, for each area, the correction value stored in the correction value storage section is set as the second emission luminance, and a fourth correction mode in which, for each area, the value for the first emission luminance is set as the second emission luminance.

12. The image display method according to claim 7, wherein, the image display device further includes a correctability data storage section having stored therein correctability data corresponding to the areas as data indicating whether or not to perform a correction in accordance with the selected correction mode, and in the emission luminance correction step, the value for the first emission luminance is set as the second emission luminance for any area for which the correctability data stored in the correctability data storage section indicates that the correction in accordance with the selected correction mode is not performed.

* * * * *